United States Patent [19]

Melby

[11] 4,365,807

[45] Dec. 28, 1982

[54] GOLF CLUB INCLUDING ROTATABLE GRIP

[76] Inventor: Phillip J. Melby, 211 N. Delaware, Mason City, Iowa 50401

[21] Appl. No.: 363,540

[22] Filed: Mar. 30, 1982

Related U.S. Application Data

[63] Continuation-in-part of Ser. No. 174,114, Jul. 31, 1980, abandoned.

[51] Int. Cl.[3] ..... A63B 53/16

[52] U.S. Cl. ..... 273/81 C; 273/81 B; 273/81.4; 273/81.6

[58] Field of Search ..... 273/73 J, 75, 81 R, 273/81 B, 81 C, 81 D, 81.2, 81.3, 81.4, 81.5, 81.6, 163 R, 163 A, 183 D, 183 E, 193 R, 194 R; 145/61 EA, 61 G

[56] References Cited

U.S. PATENT DOCUMENTS

| | | | |
|---|---|---|---|
| 1,556,473 | 10/1925 | Ballou | 273/81.4 |
| 2,044,567 | 6/1936 | Daday | 273/81 C |
| 2,091,512 | 8/1937 | Marsh | 273/81 C |
| 2,200,626 | 5/1940 | Lamkin | 273/81 B |
| 2,712,765 | 7/1955 | Knight | 273/81.3 X |
| 2,876,010 | 3/1959 | Hugman | 273/81 B |
| 2,882,053 | 4/1959 | Lorthiois | 273/79 |
| 3,070,370 | 12/1962 | Steiner | 273/81.2 X |
| 3,203,697 | 8/1965 | Bezatzy | 273/75 |
| 3,806,130 | 4/1974 | Jacques | 273/81.4 X |
| 3,834,714 | 9/1974 | Smolinski | 273/81 C |
| 4,101,125 | 7/1978 | Heath | 273/75 |
| 4,204,332 | 5/1980 | Gray | 273/183 D |

*Primary Examiner*—George J. Marlo
*Attorney, Agent, or Firm*—Robert T. Johnson

[57] ABSTRACT

A golf club wherein the grip portion contains alignment indicators and is rotatable to vary the position of the indicators. The upper end of the club shaft includes a toothed collar which meshes with a toothed collar on the upper end of the rotatable grip portion. The toothed components are biased into engagement with each other by a compression spring acting on the lower end of the rotatable grip portion. The alignment indicators are in the form of a diagonally-extending elevated area located centrally around the grip portion, and a flat section extending lengthwise of the grip portion. The elevated area is formed by a diagonal wrapping.

7 Claims, 12 Drawing Figures

GOLF CLUB INCLUDING ROTATABLE GRIP

REFERENCE TO RELATED APPLICATION

This is a continuation-in-part of application Ser. No. 174114 filed July 31, 1980 for "Rotatable Grip for Golf Club" now abandoned.

BACKGROUND OF THE INVENTION

Golf clubs, as usually made, comprise a ball hitting head, affixed to a shaft and a grip located on the top or "end" of said shaft, opposite the head.

Such a golf club as above described, does not adequately align the club head face to match a golfer's stroke to eliminate a slice or a hook.

It is an object of this invention to disclose a rotatable adjustable one piece grip on the shaft of a golf club.

To more clearly define "adjustable one piece grip", this means the grip 9 of FIG. 2 and includes the toothed section 7 which is part of and fastened firmly to the grip section, thus the grip is a unitary section.

Another object of this invention is to disclose a rotatable grip section for a golf club, wherein the grip is held non-rotating or locked in a suitable index position by means of meshing of tooth sections held in position by a spring under or in compression.

A further object of this invention is to disclose a method of aligning a golf club head with an index on a rotatable grip to suit an individual golfer.

Another object of this invention is to disclose a method of mounting a rotatable grip area on the shaft of a golf club.

Another object of this invention is to disclose a rotatable one piece grip section for a golf club including a grip section wrap and flat section on said grip to align the hands on the grip, and wherein the grip is held non-rotating or locked in a suitable position by means of meshing tooth sections held in position by a spring under or in compression.

Another object of this invention is to disclose a method of mounting a rotatable one piece grip area on the shaft of a golf club, such that on aligning the index with the golf club head that the grip area is then firmly anchored in position while using the club to hit the ball.

Another object of this invention is to disclose a golf club wherein the grip section can be rotated on the shaft to index the player's grasp of said grip to open or close the club head hitting surface, to correct for a slice or hook.

Another object of this invention is to disclose a golf club and grip therefor comprising a rotatable one piece grip section on the shaft, wherein the grip can be locked in a suitable index position by means of meshing of tooth sections held in position by means of a spring in compression, such that the grip section is non-rotating when hitting a golf ball.

Another object of this invention is to disclose a rotatable one piece grip section mounted on the shaft of a golf club, and means to lock said grip comprising a spring in compression, one end of which spring is against a fixed collar firmly anchored on said shaft and the other end of said spring is against the inside shoulder of said grip, whereby a toothed section mounted on said grip meshes with a toothed section rigidly mounted on the end of said shaft to hold the grip non-rotatable.

Foregoing patents pertaining to this invention are:

U.S. Pat. No. 2,876,010 to Hugman

U.S. Pat. No. 3,806,130 to Jacques
U.S. Pat. No. 3,834,714 to Smolinski
U.S. Pat. No. 4,204,332 to Gray
U.S. Pat. No. 2,091,512 to Marsh
U.S. Pat. No. 2,882,053 to Lorthiois
U.S. Pat. No. 2,044,567 to Daday
U.S. Pat. No. 3,203,697 to Berzatzy
U.S. Pat. No. 4,101,125 to Heath
U.S. Pat. No. 1,556,473 to Ballow
U.S. Pat. No. 2,200,626 to Lamkin
U.S. Pat. No. 2,712,765 to Knight None of the above patents, however, cover this present invention.

U.S. Pat. No. 2,876,010 describes a golf club with a grip adjustable to a selected position, and then sealed so that the position of the grip may not be changed; thus this patent differs from this present application.

U.S. Pat. No. 3,806,130—for Golf Club Grip Training Aid — This is merely a sleeve with a recess or notch for the thumb of the rearward hand. This sleeve is just a teaching aid for improving the grip.

U.S. Pat. No. 3,834,714—Practice Golf Club. In this patent the grip is divided transversely into two parts. The top half is immovably mounted on the shaft while the lower half is freely rotatable.

U.S. Pat. No. 4,204,332—Golf Aid. This patent covers an indicator scale on the club shaft, with a manually moveable pointer. This indicator is mounted on the shaft, below the grip.

U.S. Pat. No. 2,091,512—this patent comprises a two piece grip and a lock nut; there is no compression spring to mesh the tooth sections.

U.S. Pat. No. 2,882,053—this patent covers only mounting of a golf club head adjustable for pitch only and has nothing to do with a golf club handle. This does not touch this present application.

Daday U.S. Pat. No. 2,044,567—this patent covers variable spring compression and covers movement of the club head in response to centrifugal action when the club is swung to strike the ball.

U.S. Pat. No. 3,203,697—this is for a "Stable Grip Tennis Racket Handle"—This has an "L" shaped support on the racket handle. The handle is held rigid after suitable adjustment.

U.S. Pat. No. 4,101,125—This patent is for "Adjustable Tennis Racket". This patent does not include tooth meshing for a grip, and in this patent the handle grip must be disassembled for resetting for further rotation.

U.S. Pat. No. 1,556,473—this covers mainly a gripping handle for a golf club which invention is based on a row of depressions for placemnt of fingers. This then does not touch this present Melby invention.

U.S. Pat. No. 2,200,626—this is for bead wrap covering only the region which is normally engaged by the upper hand of the golfer. There are no similarities of this Lamkin patent and this present Melby application.

U.S. Pat. No. 2,712,765—this patent covers a "Wrist-Motion Rotary Hand-Tool". This patent does not cover meshing of collars by a spring but instead relies on "a spring compressing forward thrust of the grip member, the teeth will engage to lock the shaft against rotation in the grip member". This is just the opposite of this present Melby application wherein the spring in compression meshes the toothed sections. In this Knight patent, the spring is to separate the toothed sections.

Figure 1:
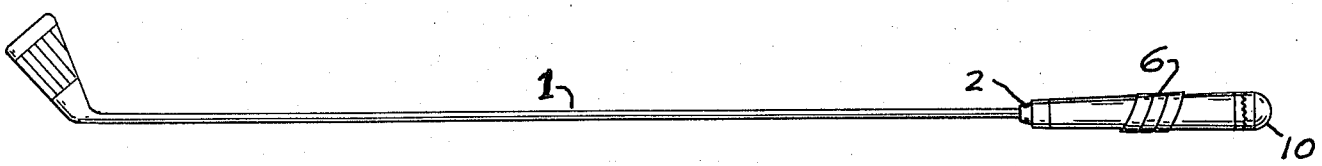
FIG. 1—Golf Club showing rotatable one piece grip 9, anchored end cap 10, and fixed collar 2 mounted on shaft 1; wrap 6 is anchored on grip 9.

Fixed collar 2 abuts spring 4, within Floating collar 3 which is on the end of rotatable grip 9, which in turn is mounted on Shaft Sleeve 5. Mounted on rotatable grip 9, is a raised grip section wrap 6, and toothed collar 7. Fixed tooth collar 8 is mounted on shaft end cap 10, which in turn is anchored on end of shaft 1, with a suitable screw 12. Index 11 is to indicate the setting or amount of rotation of grip 9.

Toothed collar 7 attached on rotatable grip section 9, and fixed toothed collar 8 can be referred to as the tooth or toothed sections, and by meshing of these toothed sections 7 and 8, held in position by spring 4 the grip 9 is held in a non-rotatable or rigid position.

Figure 3:
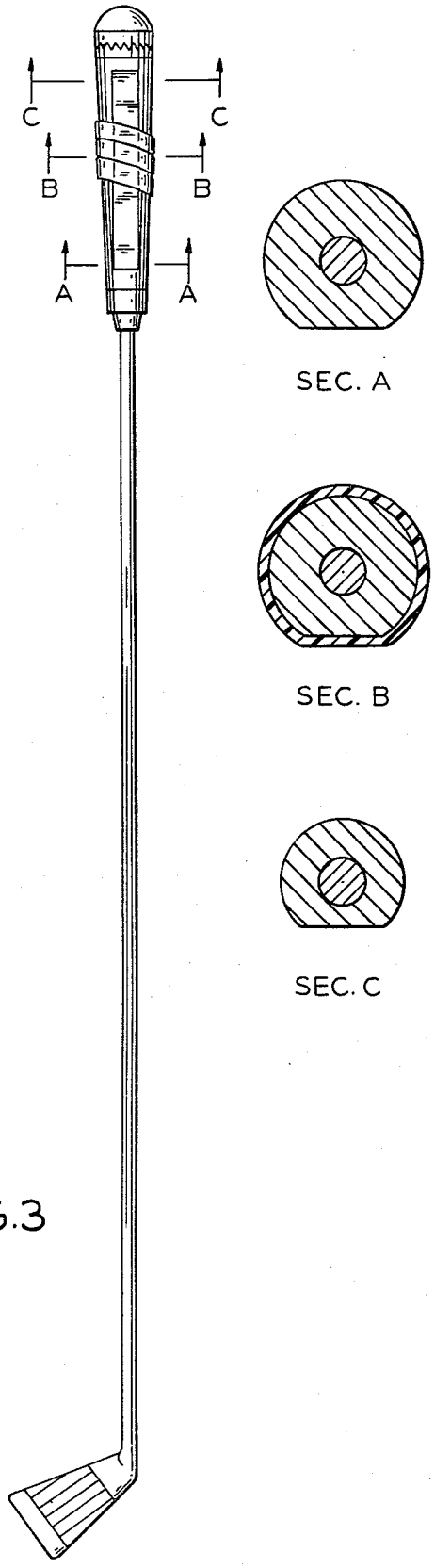

FIG. 3 shows the rotatable grip 9, mounted on golf club shaft 1. Cross sections Sec. A, B and C are enlarged to show the flat section on the grip, which flat section extends from A—A to C—C. Diagonal wrap 6 is in the center of the grip 9.

The diagonal wrap 6 is a raised section on rotatable grip 9. This diagonal wrap may be leather, plastic or rubber and serves to index the hands on grip 9.

This diagonal wrap is mounted on the central section or portion of the grip.

Figure 4:
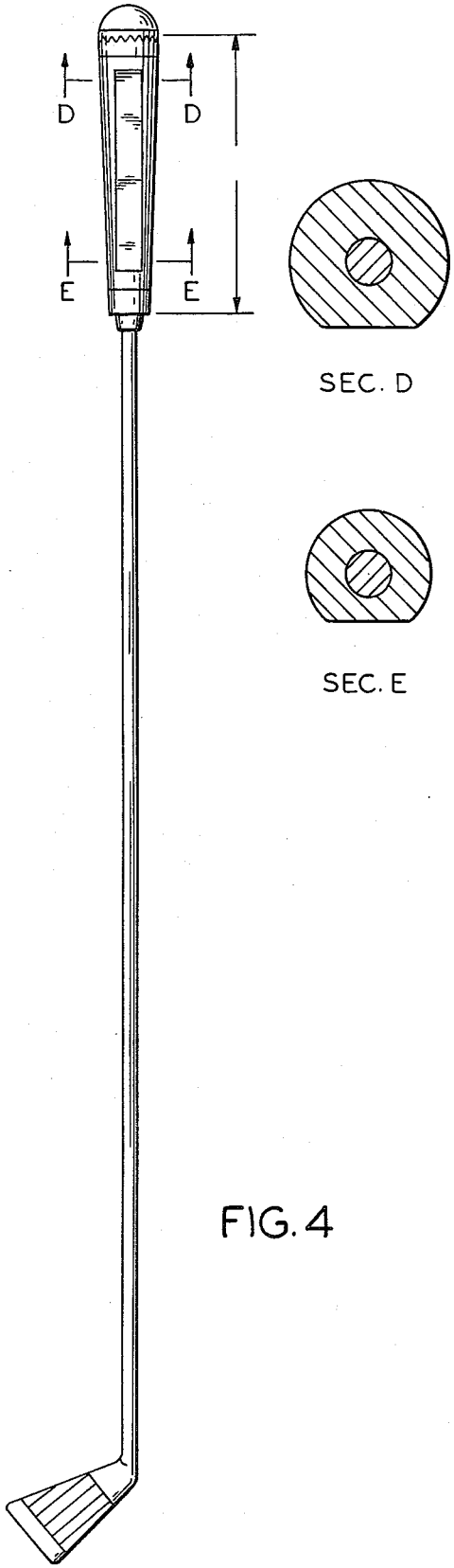

FIG. 4 shows the rotatable grip 9 mounted on golf club shaft 1. Cross sections Sec. D and E are enlarged to show the flat surface along one side of the grip. The flat section extends from D—D to E—E.

Figure 5:
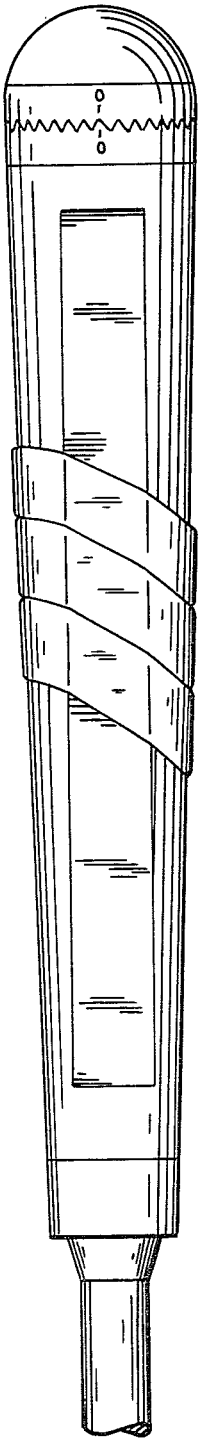
Figure 6:
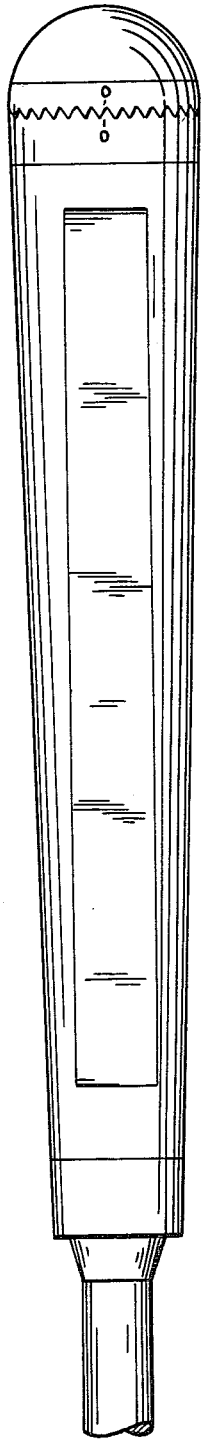

FIGS. 5 and 6 are enlarged views of the grip, with wrap 6 in FIG. 5 and without the wrap in FIG. 6, and both figures showing flat section A—C in FIG. 5, and flat section D—E in FIG. 6.

Figure 7:
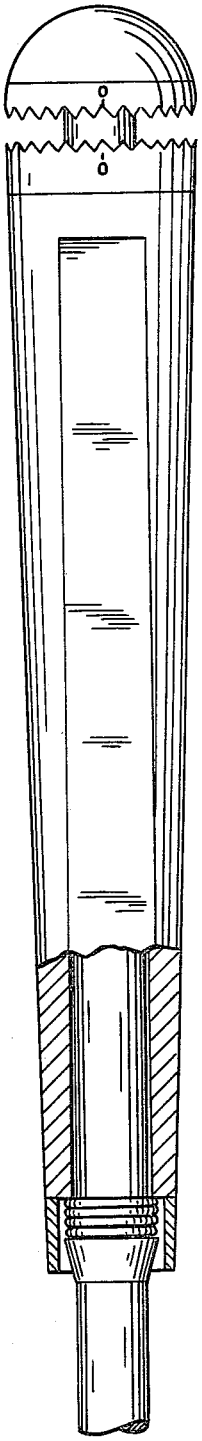

FIG. 7 is an enlarged view showing the spring A under maximum compression to disengage toothed sections 7 and 8 to allow rotation of grip section 9.

DESCRIPTION OF THE INVENTION

The drawings illustrate this invention by showing a golf club with the rotatable one piece grip section on the handle.

The rotatable golf club grip section is designed so that in use a golfer may adjust the grip in order to open or close the face of the club to counteract slicing or hooking.

To use the invention for its intended purpose, shaft 1 is grasped by one hand, the other hand is to grasp the grip 9. The one hand is to push the grip 9, toward the other hand on shaft 1, this then compresses spring 4 and separates meshed toothed collars 7 and 8, and grip 9 is rotated in either direction, depending on hook or slice correction. On release of grasp on shaft 1 spring 4 exerts a force on rotatable grip 9 by forcing against fixed collar 2, and internal shoulder 13, of rotatable one piece grip 9, to force toothed collars 7 and 8 to mesh, in a new position to be indicated on index mark 11. On swinging the club centrifugal force will assist in additional lock-up of the toothed meshed collars.

The rotatable grip handle is rigidly held non-rotating when hitting a golf ball. This is attained by meshing of tooth collars 7 and 8, by the action of spring 4 in compression. Tooth collar 7 can be referred to as having the grip section teeth while 8 can be referred to as fixed teeth or fixed tooth section anchored firmly on end of shaft 1.

The meshing of tooth sections 7 and 8 or otherwise referred to as toothed collars 7 and 8 are held together by compression spring 4, after rotating the grip to the desired position, as can be indicated by index mark 11.

The wrap 6 may be leather or similar meterial, and is to align the hands on the grip in the same position each time the club is used.

Figure 2:
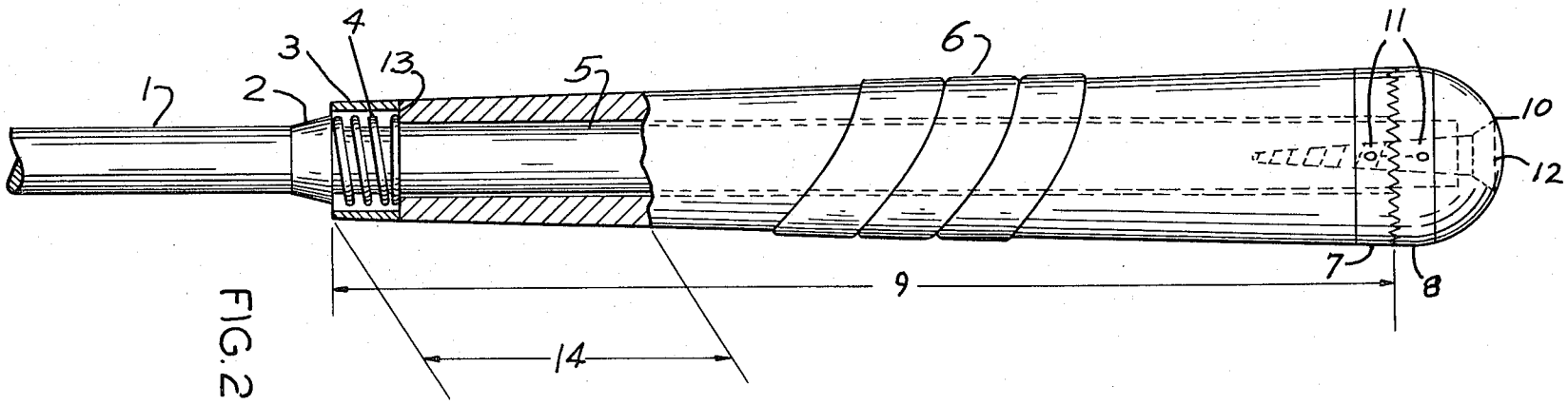
FIG. 2—This is an expanded view of the rotatable grip 9 and its relation to other components comprising the handle of the golf club, and includes cut away section 14, to show abutment of spring 4 on internal shoulder 13, of rotatable one piece grip 9 and fixed collar 2, and the relation of the above to the shaft 1 of the golf club.

As seen in the drawing FIG. 2, wrap 6 is diagonal, and is a raised section on rotatable grip 9. This then serves to align the hands in a uniform manner relative to said grip when strokes are taken. Thus the wrap 6 is to align the hands on the grip in a consistent manner, and is located in the central portion of the grip.

To align the hands on the grip, the flat area gives a reference area, so that the grip may be grasped in the same way for each use. Further, the raised diagonal wrap serves as reference point between the hands on grasping grip.

Since the hands grasp the grip in the same position each time the club is used, then the hook or slice can be corrected by rotating the grip 9 in the correcting direction, then locking the grip in the suitable index position for hitting a golf ball straight down the fairway, or putting on the green.

Index 11, as shown in FIG. 2 is to show the setting or amount of rotation of the rotatable grip 9, as indicated by the alignment of the meshed tooth sections 7 and 8 as indicated by index 11 points 0—0 in FIG. 2.

Having described my invention, I claim:

1. A golf club and grip therefor, comprising a shaft, a head and a grip, said grip being a unitary section comprising said grip, including a toothed section, and an internal shoulder, a compression spring, and a toothed section mounted on the end of said shaft, opposite the head to mesh with toothed section on said grip.

2. A golf club and grip therefor according to claim 1, wherein a diagonal raised section wrap is mounted on said grip.

3. A golf club and grip therefor according to claim 1, with a flat section extending lengthwise of said grip and a diagonal raised section wrap mounted in the central section of said grip.

4. A golf club and grip therefor according to claim 1, wherein a flat section extends lengthwise of the grip.

5. A golf club and grip therefor comprising a rotatable unitary grip for said golf club and comprising said grip mounted on club shaft and having affixed on one end of said grip a toothed collar, and a toothed collar fixed on the end of the golf club shaft, said toothed sections to be held in mesh by means of a spring in compression on the grip end opposite said toothed sections and a diagonal raised section on said grip, and a flat section extending lengthwise of said grip.

6. A golf club and grip therefor comprising a rotatable unitary grip held non-rotating by means of toothed sections held meshed together by means of a spring in compression.

7. A golf club and grip therefor comprising a head, shaft and grip, the said grip being a unitary section comprising an inner shoulder, a spring under compression and a toothed section and a toothed section on said shaft whereby said toothed sections mesh together.

* * * * *